United States Patent [19]

Meek

[11] 4,288,122

[45] Sep. 8, 1981

[54] WHEEL CHAIR TABLE CLAMP

[76] Inventor: Lloyd F. Meek, 4589 Phillips Rice Rd., Cortland, Ohio 44410

[21] Appl. No.: 37,309

[22] Filed: May 9, 1979

[51] Int. Cl.[3] ..... A47C 7/70

[52] U.S. Cl. ..... 297/153

[58] Field of Search ..... 297/153, 154, 148, 149, 297/DIG. 2; 292/202, 101

[56] References Cited

U.S. PATENT DOCUMENTS

| | | | |
|---|---|---|---|
| 1,347,048 | 7/1920 | Mardaus | 292/103 |
| 1,494,692 | 5/1924 | Lohlker | 248/188.9 X |
| 1,552,104 | 9/1925 | Zahner | 248/188.9 X |
| 1,693,166 | 11/1928 | Walcom | 297/148 X |
| 2,032,055 | 2/1936 | Hiering | 292/202 |
| 2,937,694 | 5/1960 | Willson et al. | 297/153 |
| 3,649,074 | 3/1972 | McDonald | 297/153 |
| 3,813,714 | 6/1974 | Sater | 297/148 X |
| 3,987,994 | 10/1976 | Frankford | 297/153 X |
| 4,054,315 | 10/1977 | Czarnowski | 297/153 |
| 4,082,349 | 4/1978 | Ballenger | 297/153 |

*Primary Examiner*—Roy D. Frazier
*Assistant Examiner*—Peter A. Aschenbrenner
*Attorney, Agent, or Firm*—Webster B. Harpman

[57] ABSTRACT

A table clamp for removably attaching a table or the like to a wheel chair has vertically positioned hollow body members that engage legs on the table, movable inverted L-shaped members having opposed tabs for engagement against the chair frame are pivoted to the hollow body members.

4 Claims, 4 Drawing Figures

WHEEL CHAIR TABLE CLAMP

BACKGROUND OF THE INVENTION (1) Field of the Invention

This invention relates to wheel chair table clamps which are used to detachably mount tables or desks to wheel chairs.

(2) Description of the Prior Art

Prior table clamps have used spring urged levers. See for example U.S. Pat. Nos. 3,987,994 and 2,937,694.

Other prior art patents utilized slots and clamping means. See for example U.S. Pat. No. 4,054,315.

In U.S. Pat. No. 3,987,994, a wheel chair clamp is disclosed having a spring tensioned lever that is arranged for engagement with the frame of the wheel chair.

Applicant's device has inverted L-shaped movable body members with pairs of oppositely disposed tabs extending therefrom for clamping engagement with the frame of the wheel chair and pivots the table relative thereto.

In U.S. Pat. No. 2,987,694 a device having a spring tensioned shaped lever is used for securing a contoured support body member to the wheel chair frame.

Applicant's device has hollow body members with movably attached clamping members with pairs of tabs extending therefrom which engage against the horizontal and vertical frame members of the wheel chair.

SUMMARY OF THE INVENTION

A table clamp for detachably securing a table or the like to a wheel chair has hollow body members which receive and hold depending portions of a table, each hollow body member has an inverted L-shaped member hinged thereto with outturned opposed tabs for engagement against horizontal and vertical frame members of the wheel chair. The arrangement is such that both horizontal and vertical movement of the table secured thereto is prevented.

DESCRIPTION OF THE PREFERRED EMBODIMENT

Figure 1:
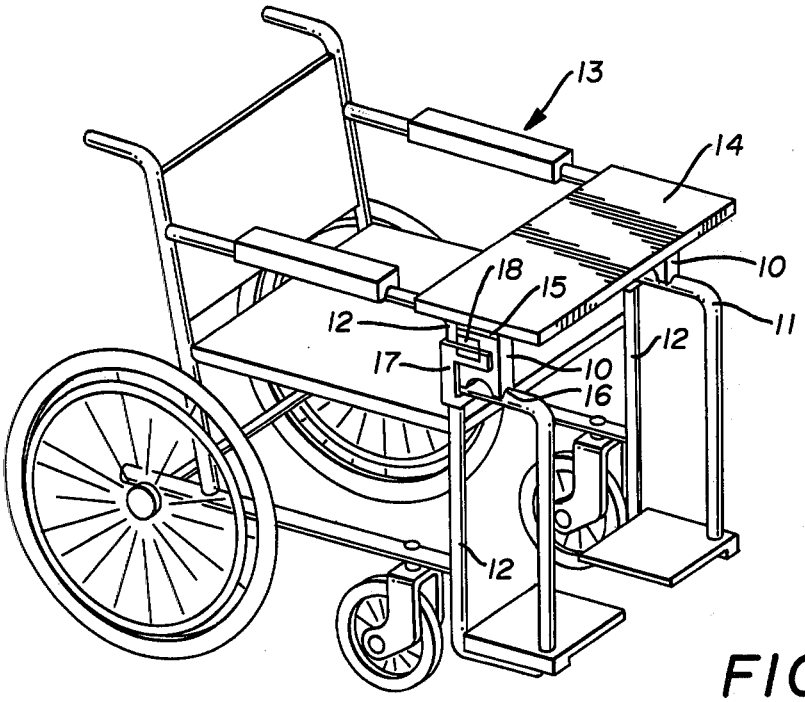
FIG. 1 is a perspective view of the table clamps and attached table on a wheel chair.

In the form of the invention chosen for illustration, a table clamp for wheel chairs comprises, as will be seen in FIG. 1 of the drawings, a pair of hollow body members 10 positioned on tubular horizontal frame members 11 and engaging tubular vertical frame members 12 of a wheel chair 13. A table 14 has a pair of depending legs 15 engaged in the hollow body members 10. Each of the hollow body members 10 has a transversely arcuate lower end 16 for engagement with the horizontal frame members 11 of the wheel chair 13. Inverted L-shaped clamping members 17 are pivotally secured by hinges 18 to the hollow body members 10 and each of the inverted L-shaped clamping members 17 has a pair of oppositely disposed right angular tabs 19 and 20 extending therefrom for engagement with the frame members 11 and 12 of the wheel chair 13 so as to secure the hollow body members 10 against both vertical and horizontal movement and providing a secure mounting for the table 14.

Figure 2:
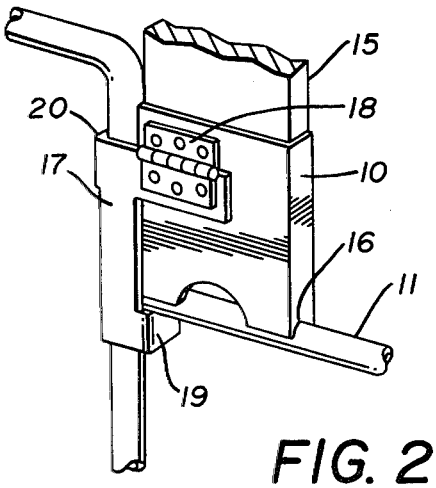
FIG. 2 is an enlarged view of one of the table clamps seen in FIG. 1.
Figure 3:
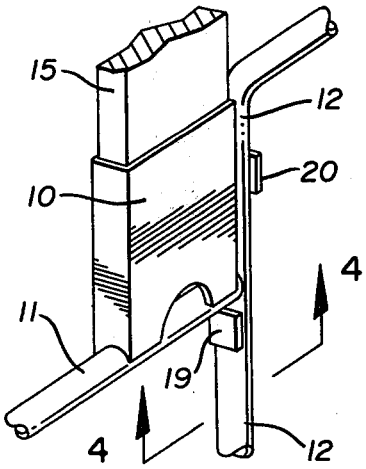
FIG. 3 is an opposite side view of the table clamp seen in FIG. 2.
Figure 4:
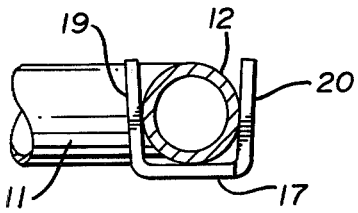
FIG. 4 is a cross section on line 4—4 of FIG. 1.

In FIGS. 2, 3 and 4 of the drawings, the right angular tabs 19 and 20 are shown in engagement with the tubular frame member 12 and it will be seen that the area between the tabs 19 and 20 is smaller than the diameter of the tubular frame member 12 so that a clamping action is achieved between the right angular tabs 19 and 20 and the tubular frame member 12. The spacing of the tab 20 with respect to the lower arcuate ends 16 of the hollow body members 10 also results in a clamping action between the ends 16 and the tubular frame members 11 when the inverted L-shaped clamping members 17 are moved into the position shown in FIGS. 1, 2 and 3 of the drawings.

In use the hollow body members 10 with said table 14 attached thereto by its legs 15, are positioned on the horizontal frame members 11. By moving the inverted L-shaped clamping members 17 arcuately into the positions shown in the drawings, the tabs 19 and 20 engage the tubular frame members 12. The tabs 20 engage both the tubular frame members 11 and 12 thus securely attaching the table 14 to the wheel chair 13.

Although but one embodiment of the present invention has been illustrated and described, it will be apparent to those skilled in the art that various changes and modifications may be made therein without departing from the spirit of the invention and having thus described my invention

What I claim is:

1. A clamp is adapted to mount a table on a wheel chair having a pair of horizontally spaced vertically disposed tubular frame members, each having a horizontal tubular frame member intersecting and projecting therefrom with said horizontal members parallel to each other, said clamp comprising a pair of vertically disposed body members adapted to hold a table on said horizontal frame members adjacent said vertical frame members, a clamping member on each body member, pivot means pivotally mounting each clamping member to its respective body member so that the clamping member is disposed adjacent a vertical frame member, said clamping member having opposite vertical sides, each of which sides having a right angularly disposed tab thereon, said tabs on each clamping member vertically spaced on the clamping member and projecting towards the tabs on the other clamping member with the lower tab on each clamping member being disposed below its body member, whereby when the body members have their lower edges mounted on the horizontal frame members, each clamping member is pivoted to clamp the tabs on opposite sides of a vertical frame member with the lower tab disposed below the horizontal frame member to thereby secure the body member and a table carried thereby to the horizontal and vertical frame members against vertical and horizontal movement.

2. The table clamp of claim 1 and wherein said body members are hollow.

3. The table clamp of claim 1 and wherein said pivot means are hinges.

4. The table clamp of claim 1 and wherein the lower ends of said vertically disposed body members are transversely shaped so as to register over said horizontal tubular frame members.

* * * * *